US012790741B1

(12) United States Patent
Yi

(10) Patent No.: US 12,790,741 B1
(45) Date of Patent: Nov. 10, 2026

(54) IRONING HEAD AND IRONING MACHINE

(71) Applicant: SHEN ZHEN RONE PHOENIX NEST DESIGN DEVELOPMENT CO., LTD, Shenzhen (CN)

(72) Inventor: Yongjie Yi, Shenzhen (CN)

(73) Assignee: SHEN ZHEN RONE PHOENIX NEST DESIGN DEVELOPMENT CO., LTD, Shenzhen (CN)

( * ) Notice: Subject to any disclaimer, the term of this patent is extended or adjusted under 35 U.S.C. 154(b) by 0 days.

(21) Appl. No.: 19/266,329

(22) Filed: Jul. 11, 2025

(30) Foreign Application Priority Data

Jun. 26, 2025 (CN) ..... 202521331861.8

(51) Int. Cl.
*D06F 75/20* (2006.01)
*D06F 75/30* (2006.01)
*D06F 75/34* (2006.01)

(52) U.S. Cl.
CPC ..... *D06F 75/20* (2013.01); *D06F 75/30* (2013.01); *D06F 75/34* (2013.01)

(58) Field of Classification Search
CPC ..... D06F 75/20; D06F 75/30; D06F 75/24; D06F 75/34
See application file for complete search history.

(56) References Cited

U.S. PATENT DOCUMENTS

| | | | | |
|---|---|---|---|---|
| 9,745,691 | B2 | 8/2017 | Date et al. | |
| 9,915,024 | B2 | 3/2018 | Chua et al. | |
| 10,570,560 | B2 | 2/2020 | Chua et al. | |
| 2018/0340291 | A1* | 11/2018 | Kim | D06F 73/00 |
| 2025/0188674 | A1* | 6/2025 | Ren | D06F 75/24 |
| 2025/0237007 | A1* | 7/2025 | Ren | D06F 75/18 |

FOREIGN PATENT DOCUMENTS

| | | | | |
|---|---|---|---|---|
| CN | 108468196 A | * | 8/2018 | D06F 75/20 |
| CN | 113389029 A | * | 9/2021 | D06F 73/00 |
| CN | 216551240 U | * | 5/2022 | |

* cited by examiner

*Primary Examiner* — Nathan E Durham

(57) ABSTRACT

An ironing head includes a main housing, a suction housing, a steam generator and a driving member. A first end surface of the main housing defines an air inlet and a mounting port. A steam generator is installed in a hollow interior, and a steam outlet is in communication with the mounting port. The suction housing abuts against the first end surface to form a chamber, and the suction housing defines a plurality of primary inlet ports and a plurality of secondary inlet port. The mounting port, the opening and the steam outlet are in communication to form a steam channel, which is independent with the chamber. The plurality of primary inlet ports area and the plurality of secondary inlet ports are arranged corresponding to the position of the steam outlet. An ironing machine includes the above ironing head.

12 Claims, 19 Drawing Sheets

A-A

B-B

IRONING HEAD AND IRONING MACHINE

CROSS REFERENCE TO RELATED APPLICATIONS

This application claims priority benefits to Chinese Patent Application No. 2025213318618, filed on Jun. 26, 2025, the contents of which are incorporated herein by reference.

TECHNICAL FIELD

The present disclosure relates to the technical field of Garment pressing equipment, and particularly relates to an ironing head and an ironing machine incorporating.

BACKGROUND

An ironing machine is a device that treats clothing through heating, steam, and other methods. Its core function is to eliminate wrinkles and restore clothes to a smooth and crisp state. As living standards improve, ironing machines are being used in increasingly diverse everyday scenarios, leading to higher frequency of use. Consequently, the demand for higher quality steamers is also growing.

Existing ironing machines typically include a water tank. The water tank stores clean water, which is heated to boiling by a heating element to produce steam. The steam is then delivered through a movable ironing head, allowing for free movement while ironing clothes. Ironing machines perform functions such as heating, steam generation, and temperature control, meeting diverse garment care needs across various scenarios. Designs increasingly focus on component durability, smart features, and user-friendly design, enhancing overall user experience.

Currently, during steaming, garments are typically hung vertically. Therefore, ironing heads are designed with suction holes on the ironing surface (contacting the garments) connected to a vacuum system. This allows the ironing surface to automatically adhere to the fabric via suction holes and suction components, enabling single-handed operation. However, although these suction holes are integrated into the ironing surface, and typically located in areas separate and independent from the steam vents to ensure adequate steam output and effective ironing. This segregation results in poor suction performance during the steaming process, ultimately compromising the overall ironing result.

SUMMARY

A first aspect of the present disclosure provides an ironing head, including: a main housing defining a hollow interior, a first end surface of the main housing defining an air inlet and a mounting port in communication with the hollow interior; a steam generator defining a steam outlet, the steam generator being disposed in the hollow interior, and the steam outlet being in communication with the mounting port; a suction housing connected to the first end surface of the main housing, the suction housing being connected to the first end surface to form a chamber, the chamber being in communication with the air inlet, an end surface of the suction housing defining a plurality of primary inlet ports and a plurality of secondary inlet port in communication with the chamber, and the suction housing defining an opening; and a driving member disposed in the hollow interior, and the driving member defining a suction port, and the suction port being in communication with the air inlet. In response to the main housing and the suction housing are assembled, the mounting port, the opening and the steam outlet are in communication with each other form a steam channel, and the steam channel and the chamber are spatially independent.

A second aspect of the present disclosure provides an ironing machine, include the ironing head described above and a handle. The handle is provided with a power supply and a main unit, the power supply is configured to supply power to the main unit and the steam generator, and the ironing head is rotatably connected to the handle.

BRIEF DESCRIPTION OF THE DRAWINGS

The drawings that form part of the present disclosure are provided to further illustrate the present disclosure. The illustrative embodiments and their descriptions of the present disclosure are intended to explain but do not constitute an undue limitation on the present disclosure.

DETAILED WAY

Figure 1:
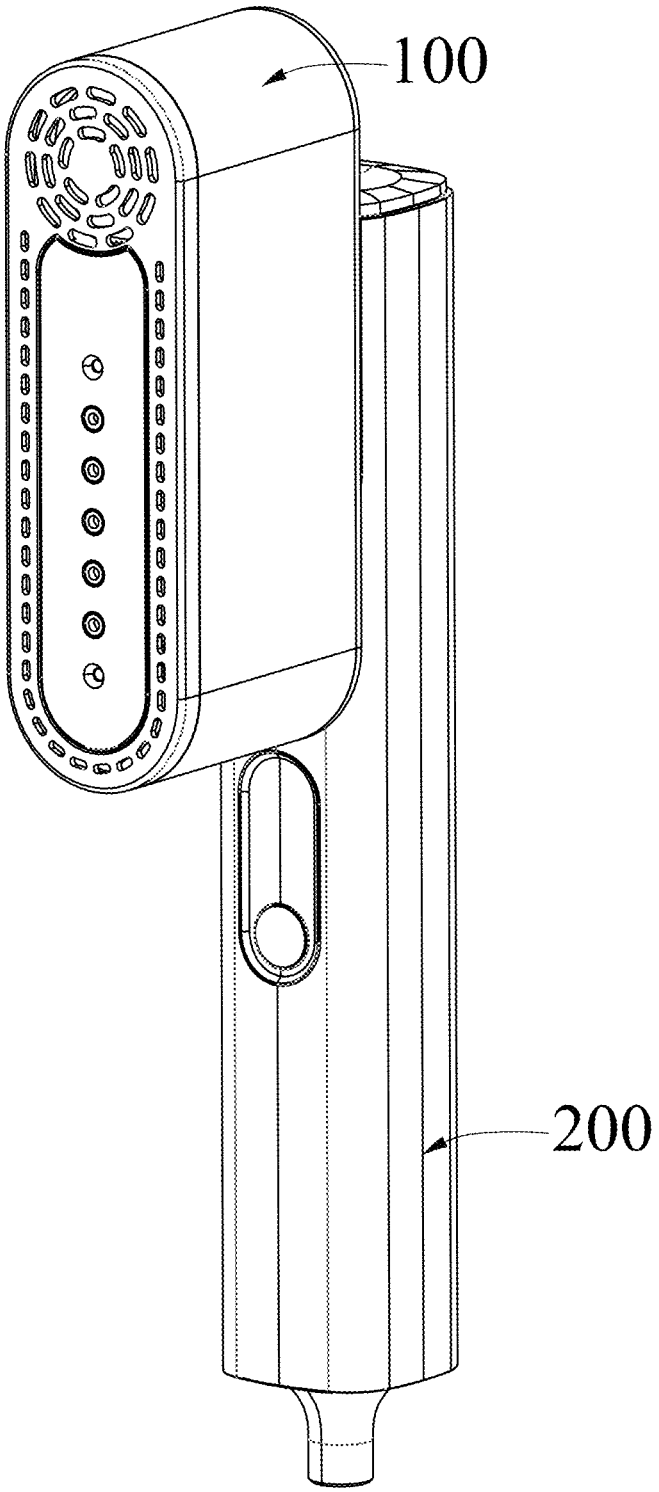
FIG. 1 is a perspective view of an ironing machine according to embodiment 1 of of the present disclosure.
Figure 2:
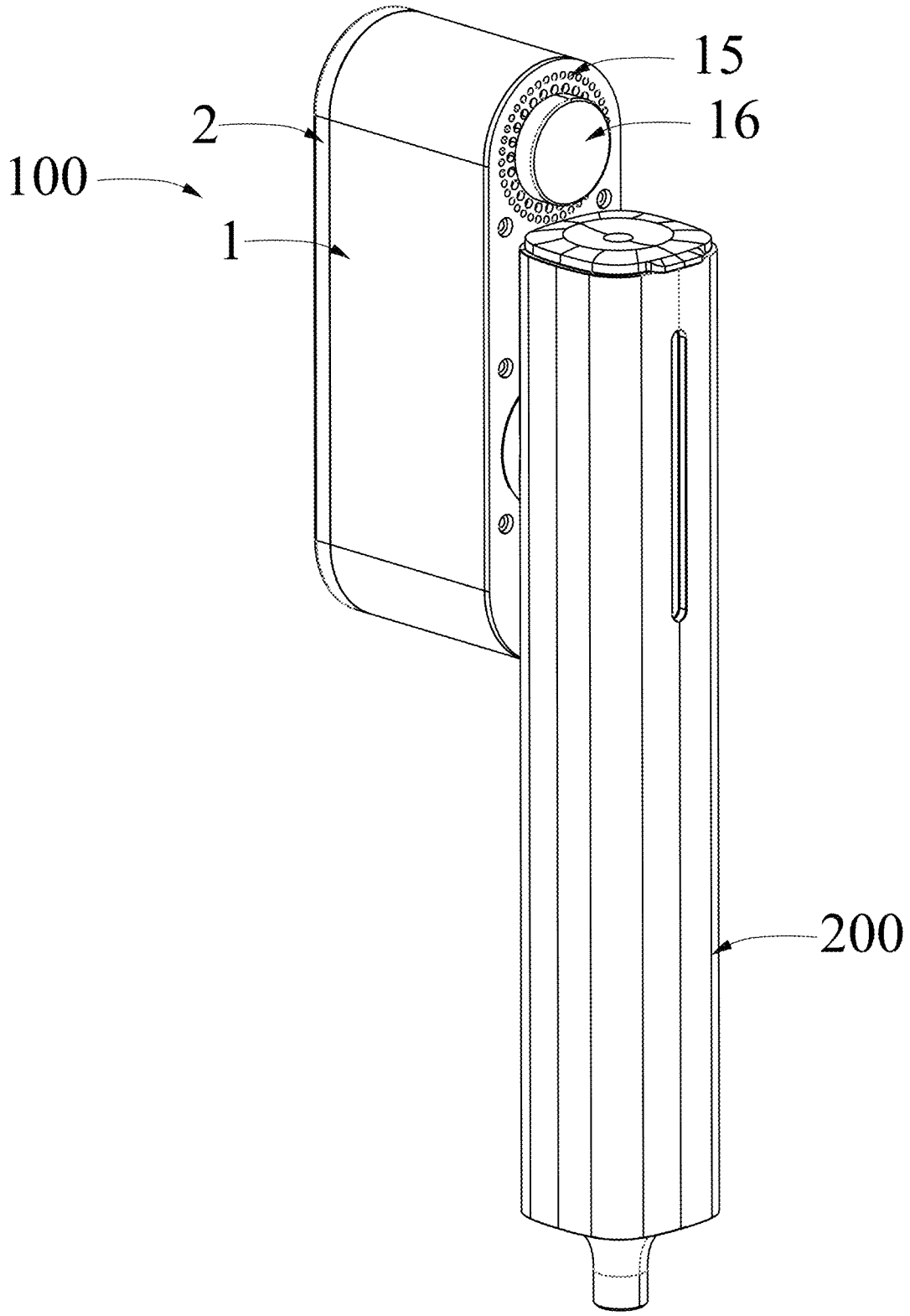
FIG. 2 is a perspective view of FIG. 1 from another angle.
Figure 3:
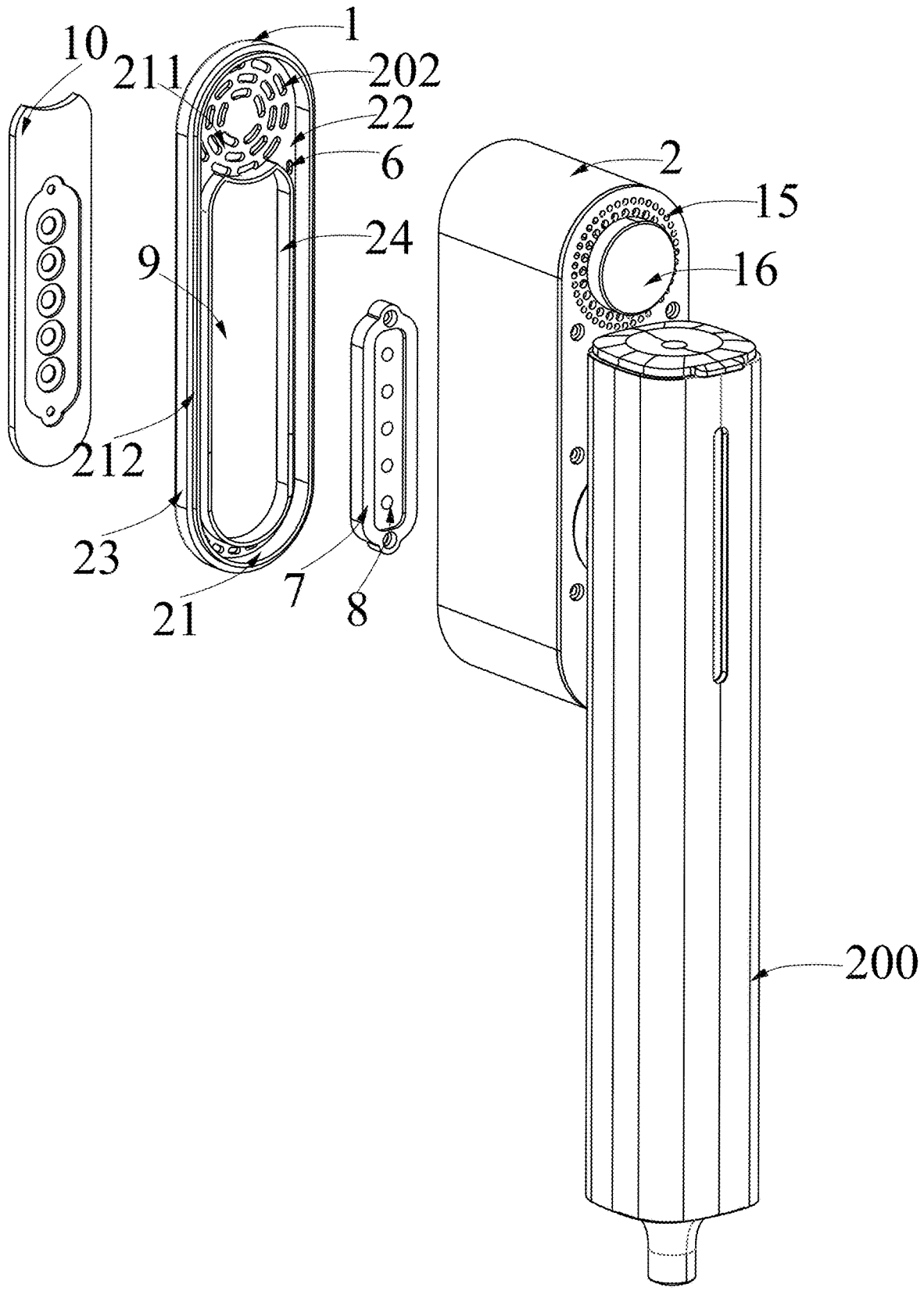
FIG. 3 is an exploded, perspective view of FIG. 2.

The following will be combined with the drawings in the embodiments of the present disclosure to clearly and completely describe the technical solutions in the embodiments of the present disclosure. Obviously, the described embodiments are only part but not all of the embodiments. Based on the embodiments in the present disclosure, all other embodiments obtained by those skilled in the art without creative work belong to the protection scope of the present disclosure.

It should be noted that all directional indications in the embodiments of the present disclosure (such as up, down, left, right, front, rear, etc.) are only configured to explain the relative position relationship, movement, etc. between the components under a certain posture (as shown in the drawings). If the specific posture changes, the directional indication will also change accordingly.

In the present disclosure, unless otherwise clearly specified, the terms "connection", "fixation", etc. should be understood in a broad sense. For example, "fixation" may be a fixed connection, a detachable connection, or an integral connection; it may be a mechanical connection or an electrical connection; it may be directly connected or indirectly connected through an intermediate medium, it may be the internal connection of two elements or the interaction relationship between two elements, unless otherwise clearly defined. For those skilled in the art, the specific meanings of the above terms in the present disclosure may be understood according to the specific circumstances.

In addition, if there are descriptions involving "first", "second", etc. in the embodiments of the present disclosure, the descriptions of "first", "second", etc. are only for descriptive purposes and cannot be understood as indicating or implying their relative importance or implicitly indicating the number of technical features indicated. Therefore, the features defined as "first" and "second" may explicitly or implicitly include at least one of the features. In addition, the meaning of "and/or" appearing in the full text includes three schemes. Taking "A and/or B" as an example, it includes scheme A, scheme B, or schemes that satisfy both A and B. In addition, the technical schemes between the various embodiments may be combined with each other, but the implementation must be based on the capability of those skilled in the art. When the combination of technical schemes is contradictory or cannot be implemented, it should be considered that such a combination of technical schemes does not exist and is not within the protection scope required by the present disclosure.

Embodiment 1

As shown in FIG. 1 to FIG. 11, the present embodiment provides an ironing machine, including an ironing head 100 and a handle 200. A main unit is provided in the handle 200, and a port for a power cord to pass through is defined at a tail of the handle 200. The main unit is powered by the power cord so as to power the main unit and a steam generator 3. The ironing head 100 is rotatably connected to the handle 200, thus suitable for different ironing directions. The main unit is a common one available on the market, and no further details are given here.

The ironing head 100 includes a main housing 1, a suction housing 2, a steam generator 3 and a driving member 4. The main housing 1 defines a hollow interior 101. A first end surface 102 of the main housing 1 defines an air inlet 5 and a mounting port 17 in communication with the hollow interior 101. The steam generator 3 defines a steam outlet 301. The steam generator 3 is installed in the hollow interior 101, and the steam outlet 301 is in communication with the mounting port 17. The suction housing 2 is connected to the first end surface 102 of the main housing 1. The suction housing 2 cooperates with the first end surface 102 to form a chamber 21, and the chamber 21 is in communication with the air inlet 5. An end surface 201 of the suction housing 2 is defined with a plurality of primary inlet ports 202 and a plurality of secondary inlet port 203 in communication with the chamber 21. The suction housing 2 is also defined with an opening 9. The driving member 4 is installed in the hollow interior 101. The driving member 4 defines a suction port 41, and the suction port 41 is in communication with the air inlet 5.

After the main housing 1 and the suction housing 2 are assembled, the mounting port 17, the opening 9 and the steam outlet 301 are in communication with each other to form a steam channel. The steam channel and the chamber 21 are spatially independent of each other. The steam channel and the chamber 21 are located in separate areas to reduce mutual air interference. Under the suction force applied by the driving member 4, the ironing head 100 creates a negative pressure in the chamber 21, allowing the steam in the chamber 21 to flow rapidly. The steam generated by the steam generator 3 is discharged from the ironing head 100 through the steam channel. The independent arrangement of the steam channel and the chamber 21 may reduce the occurrences that the airflow in the chamber 21 takes away the heat of the steam in the steam channel, thereby ensuring enough heat of the steam in the steam channel and the ironing effect of the ironing head.

Based on the ironing head 100 of the present embodiment, the suction port 41 of the driving member 4 is directly in communication with the air inlet 5, effectively shortens the path between the driving member 4 and the chamber 21, and improving the suction capacity of the ironing head 100. In other words, this reduces the possibility of attenuation of the suction capacity of the ironing head 100 due to the long path between the driving member 4 and the chamber 21. In addition, the arrangement of the plurality of primary inlet ports 202 and the plurality of secondary inlet ports 203 enables a periphery of the end surface 201 to generate suction force during operation, facilitating the ironing head 100 to secure the object being ironed, and improving ironing convenience.

In the present embodiment, the driving member 4 is a micro motor. A side of the driving member 4 close to the suction housing 2 may rotate to suck the steam at the suction port, allowing a negative pressure to be formed in the space between the driving member 4 and the suction channel.

In the present embodiment, the suction housing 2 and the main housing 1 are connected by ultrasonic welding, achieving a sealed connection between the suction housing 2 and the main housing. The two may also be bonded together. A heating element is provided in the steam generator 3, and the heating element may quickly evaporate the water dripping into the steam generator 3 to generate steam. The steam generator 3 is conventional in a handheld ironing machine in the related art, and no further elaboration is made here.

Furthermore, the main housing 1 and the suction housing 2 are both long-stripped. The first plate body 22 has a first end 221. A plurality of primary inlet ports 202 are provided, and the plurality of primary inlet ports 202 form a first main suction area at the first end 221. There are a plurality of secondary inlet ports 203, and the plurality of secondary inlet ports 203 are distributed along a circumferential edge of the first plate body 22 to form an auxiliary suction area. A first annular protrusion 23 is connected to the circumferential edge of the first plate body 22 and extends to a side where the first end surface 102 is located. A second annular protrusion 24 is connected to a circumferential edge of the opening 9 and extends to a side where the first end surface 102 is located.

The first annular protrusion 23 and the second annular protrusion 24 separate the chamber 21 to form a first main chamber 211 and an auxiliary chamber 212 that are in communication with each other. The first main suction area is located on an inner wall of the first main chamber 211, and the plurality of primary inlet ports 202 is directly in communication with the first main chamber 211. The first main chamber 211 is in communication with the air inlet 5; the auxiliary suction area is located on an inner wall of the auxiliary chamber 212, and the plurality of secondary inlet ports 203 is directly in communication with the auxiliary chamber 212.

The first main suction area defines three primary inlet port groups 20 distributed around a same center annularly, and each primary inlet port group 20 is coaxially arranged with the air inlet 5. On the one hand, this positional relationship setting may minimize the distance between the plurality of primary inlet ports 202 and the suction port of the driving member 4, thereby enhancing the suction capacity of the first main suction area. On the other hand, the plurality of primary inlet ports groups 20 distributed around the same center annularly may evenly disperse the suction force of the first main suction area, stabilizing the suction capacity of the first main suction area.

Figure 4:
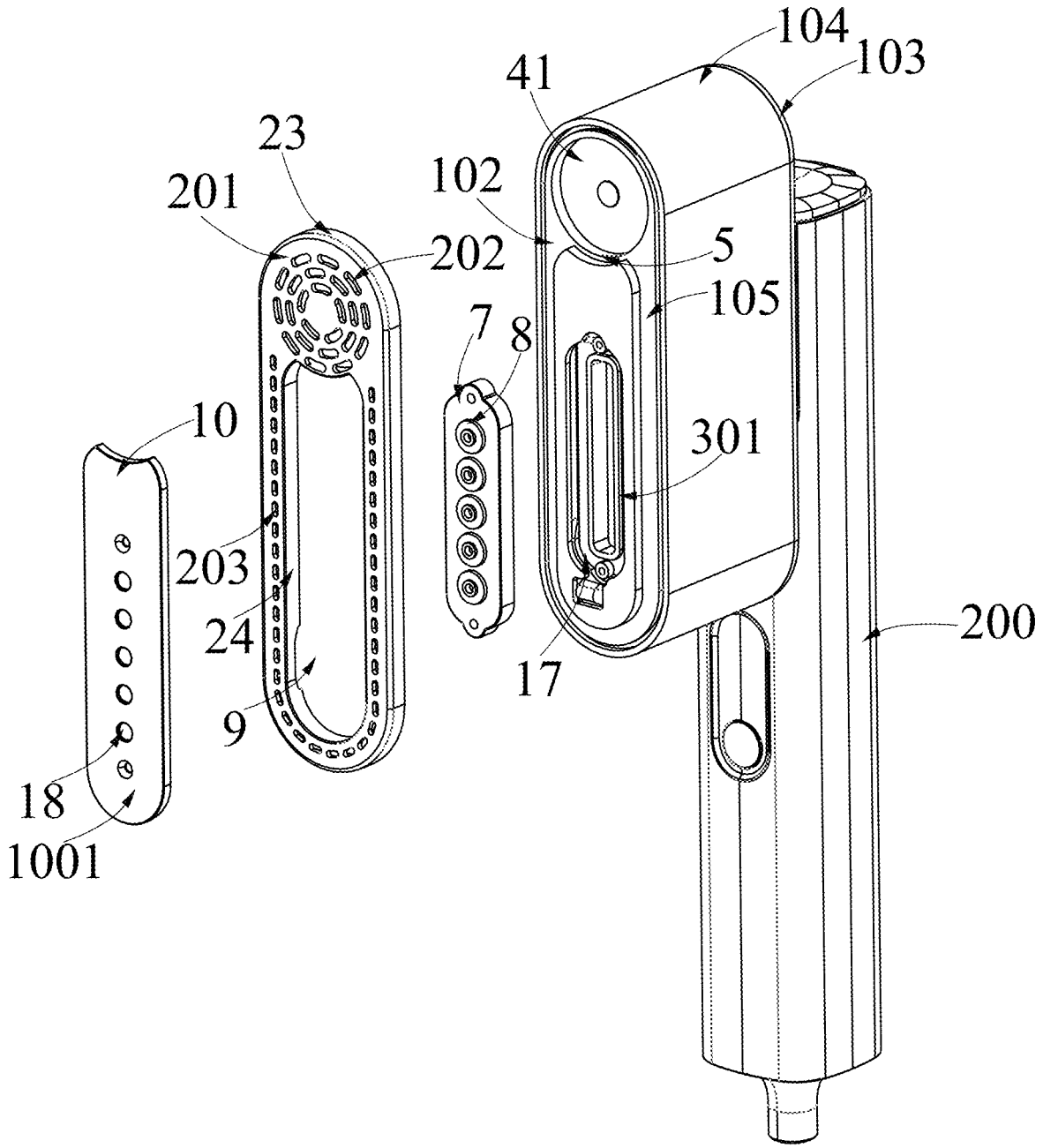
FIG. 4 is an exploded, perspective view of FIG. 1.
Figure 5:
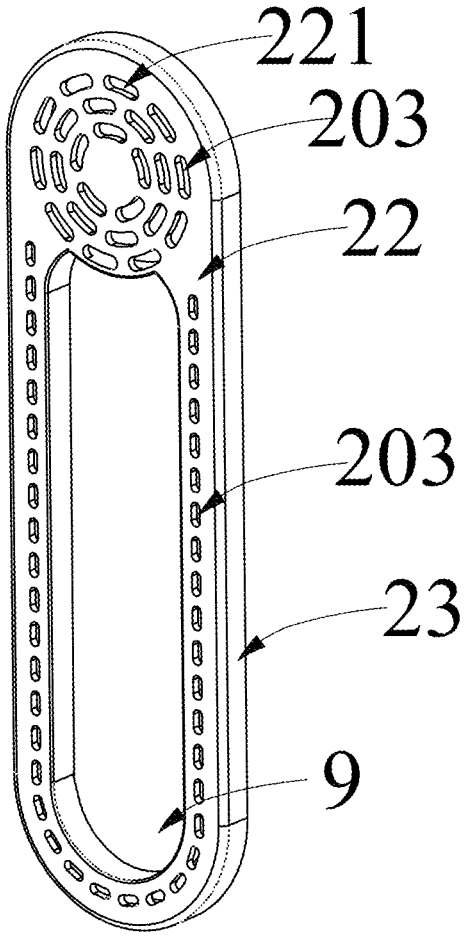
FIG. 5 is a perspective view of a suction housing of FIG. 1.
Figure 6:
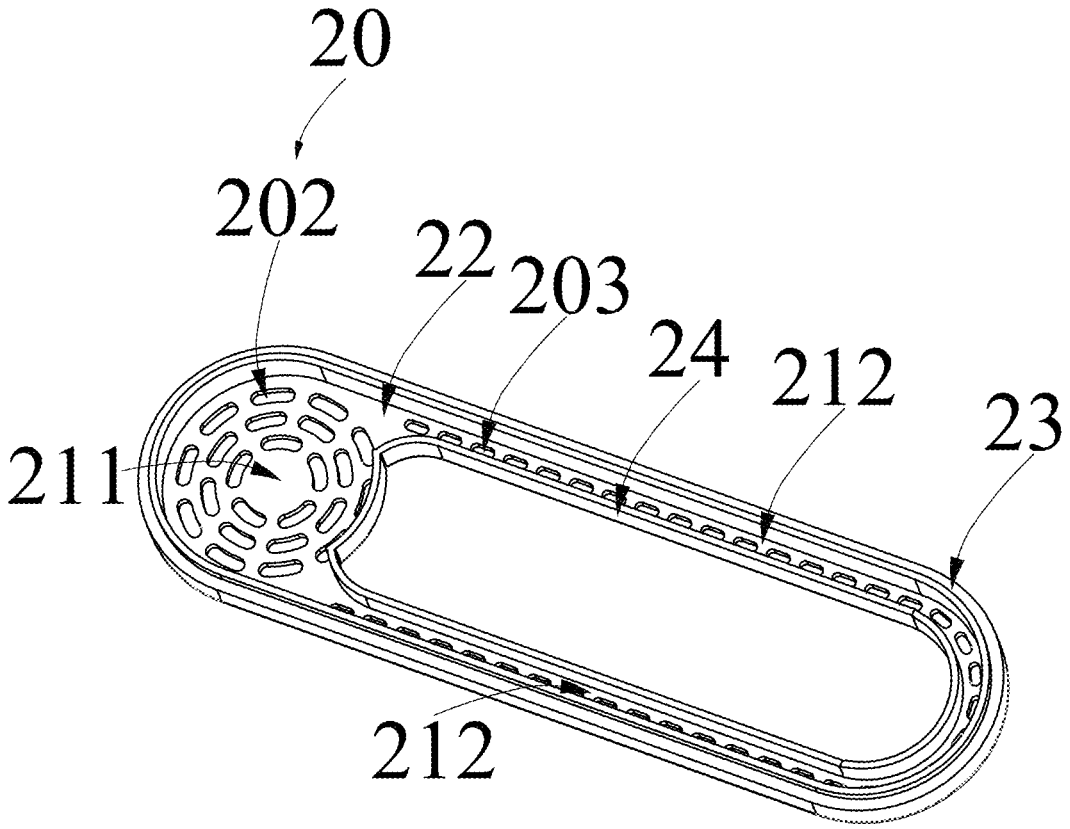
FIG. 6 is a perspective view of a suction housing from another angle of FIG. 5.
Figure 8:
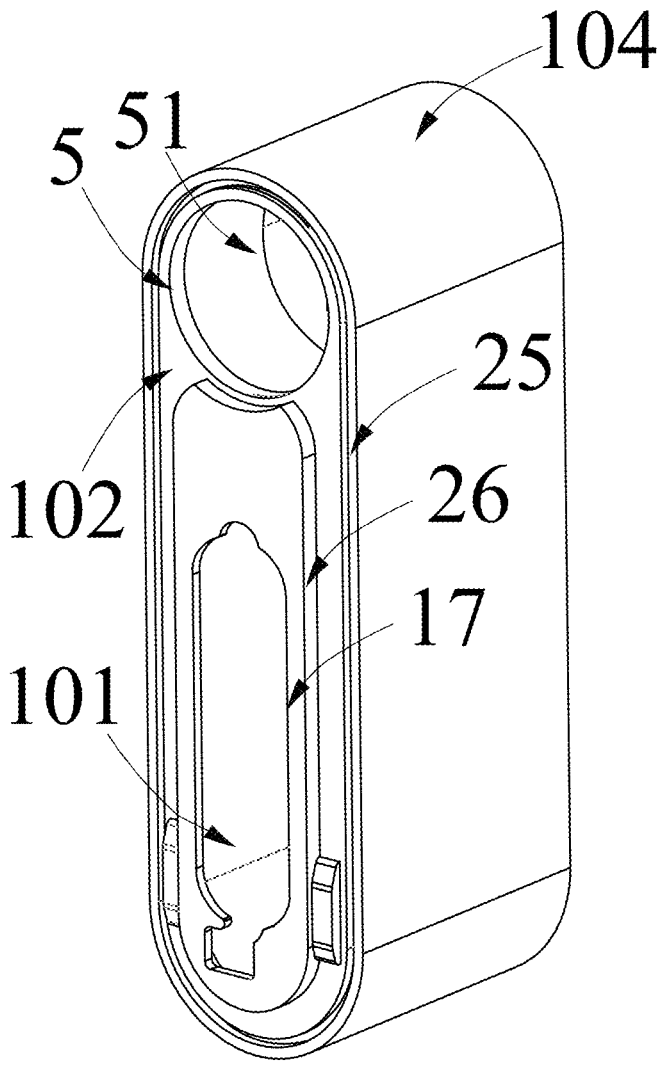
FIG. 8 is a perspective view of a main housing of FIG. 1 (the rear side plate is not shown).
Figure 9:
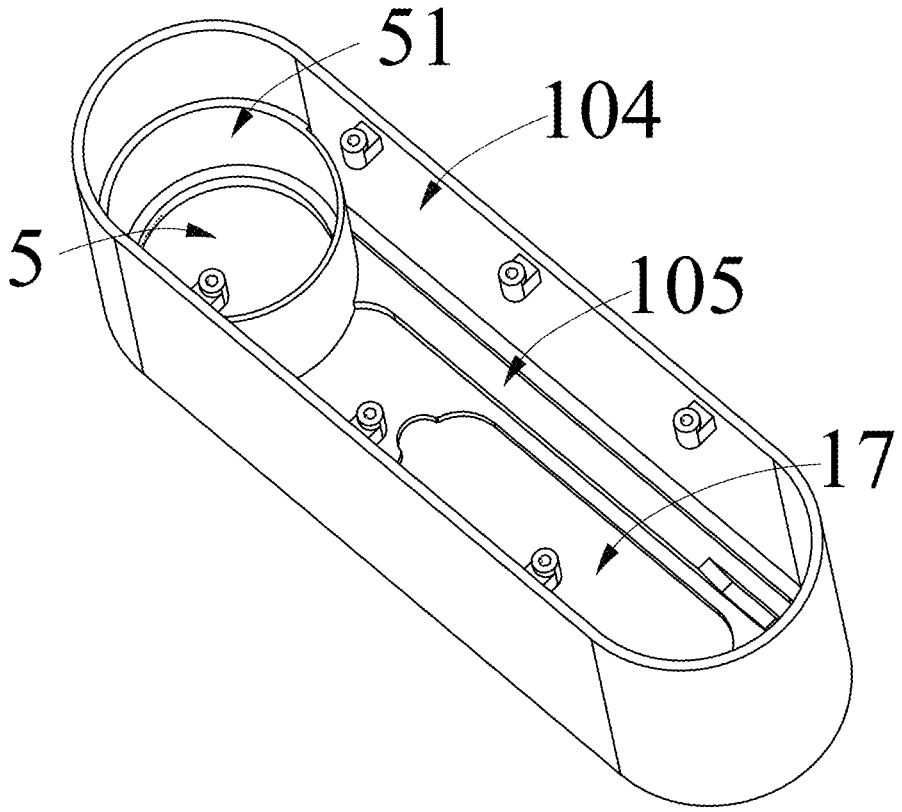
FIG. 9 is a perspective view of a main housing of FIG. 8 from another angle.
Figure 10:
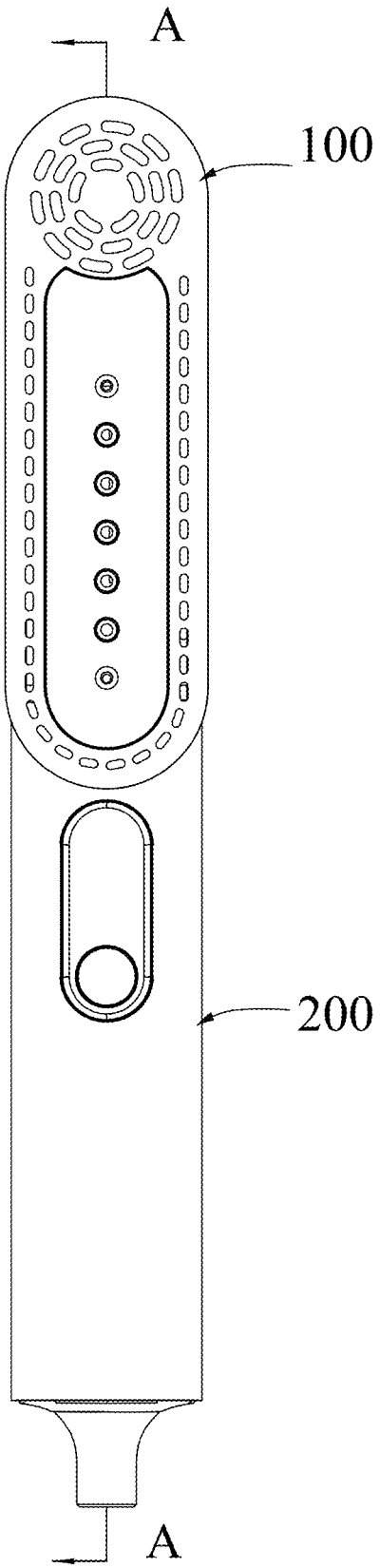
FIG. 10 is a front view of FIG. 1.
Figure 11:
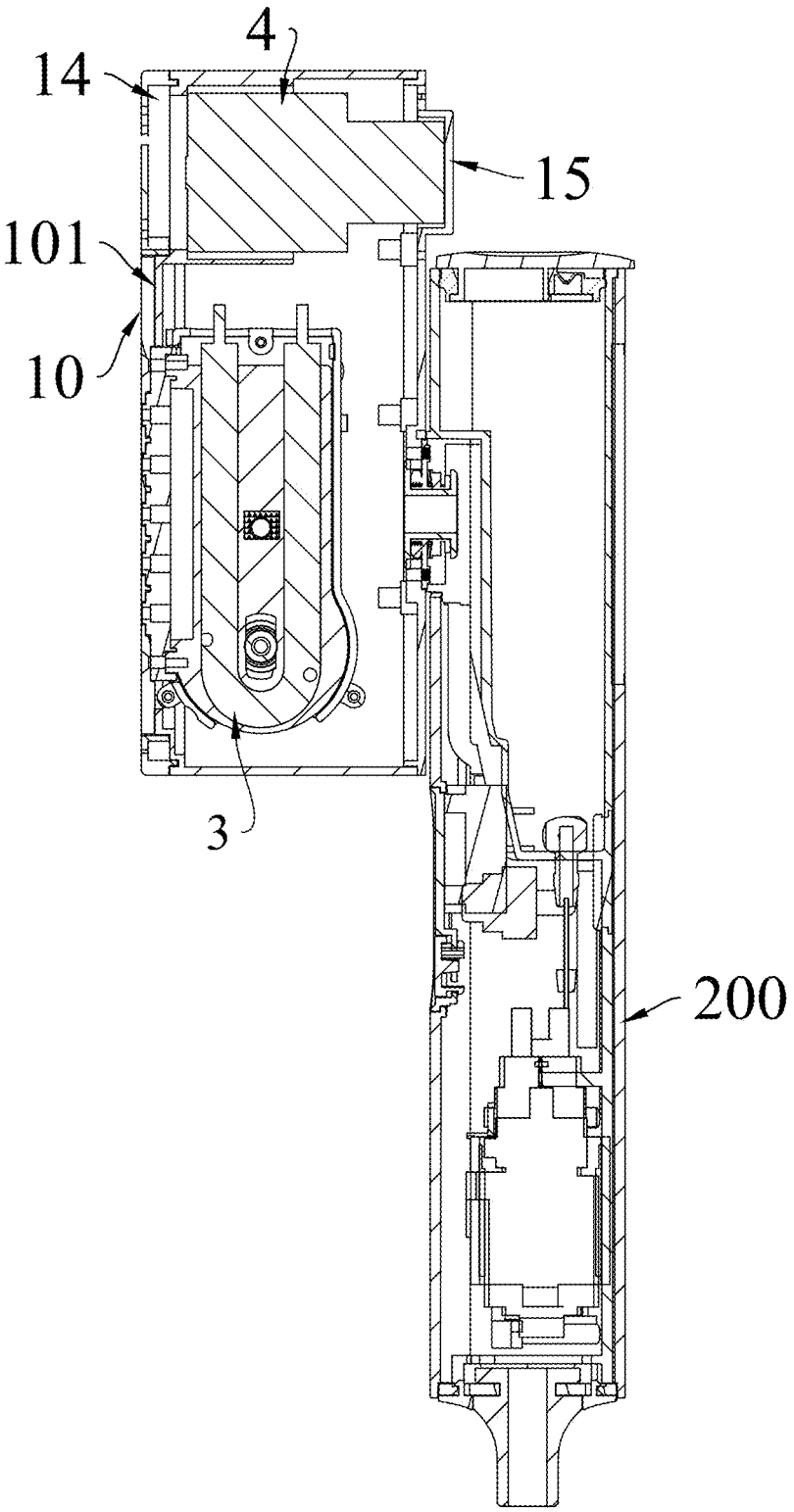
FIG. 11 is a sectional view taken along line A-A in FIG. 10.
Figure 12:
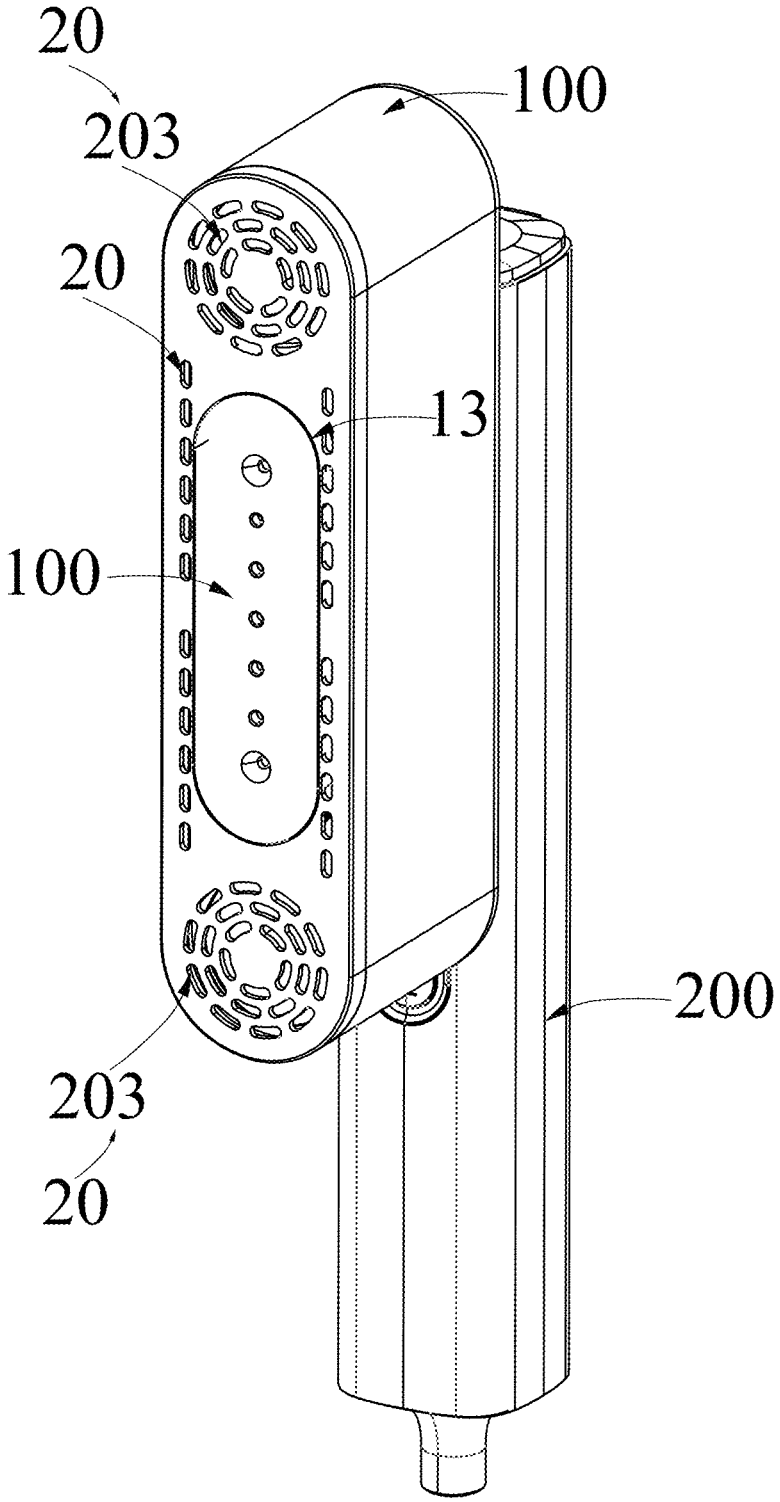
FIG. 12 is a perspective view of an ironing machine according to embodiment 2 of the present disclosure.
Figure 13:
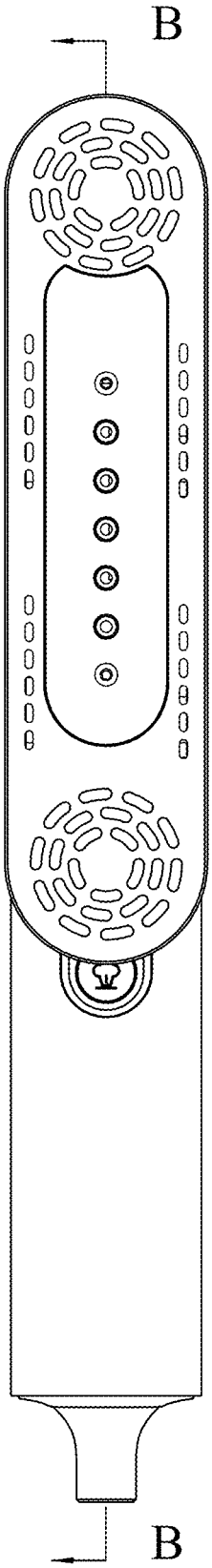
FIG. 13 is a front view of FIG. 12.
Figure 14:
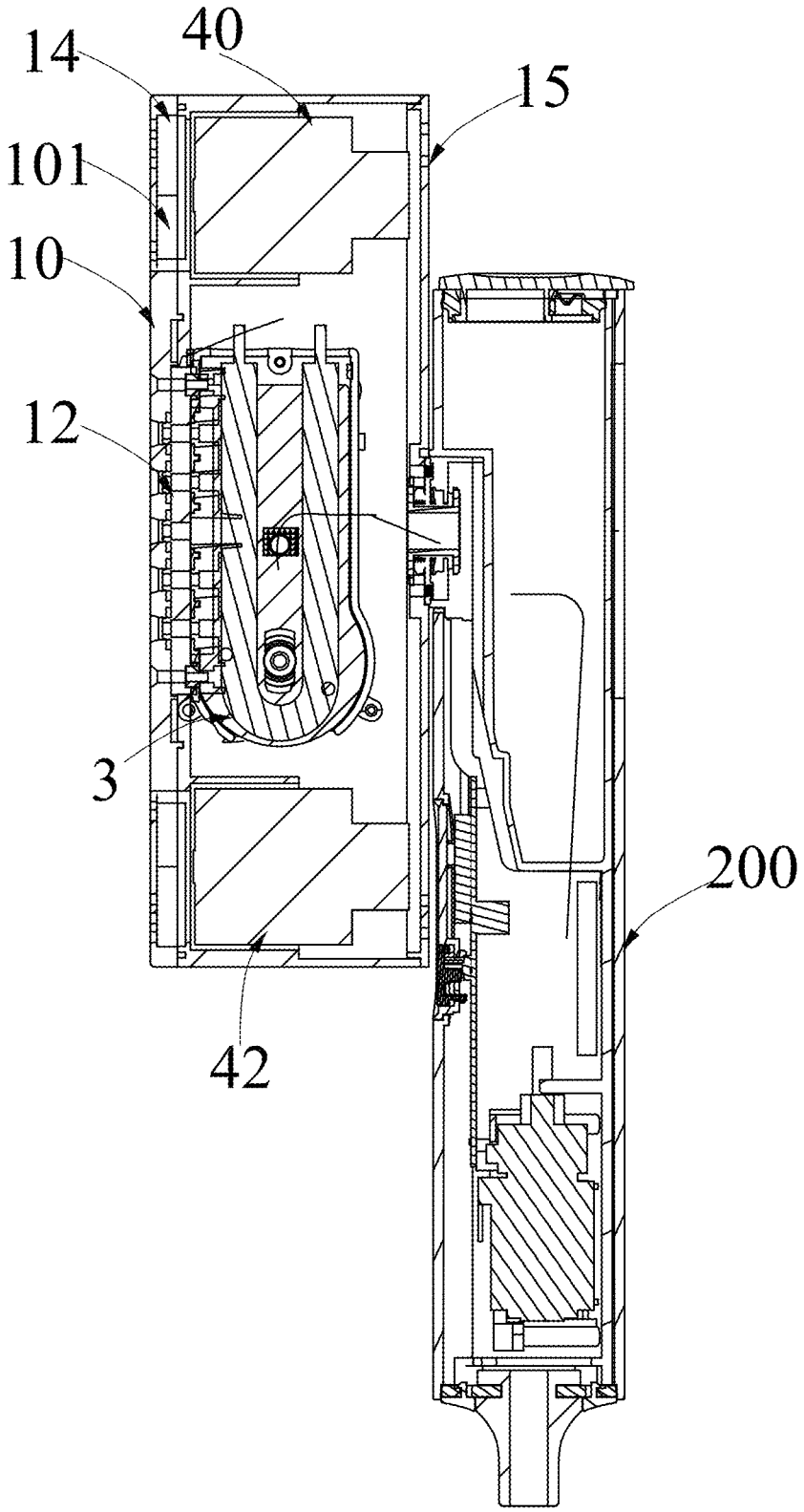
FIG. 14 is a sectional view taken along line B-B in FIG. 13.
Figure 15:
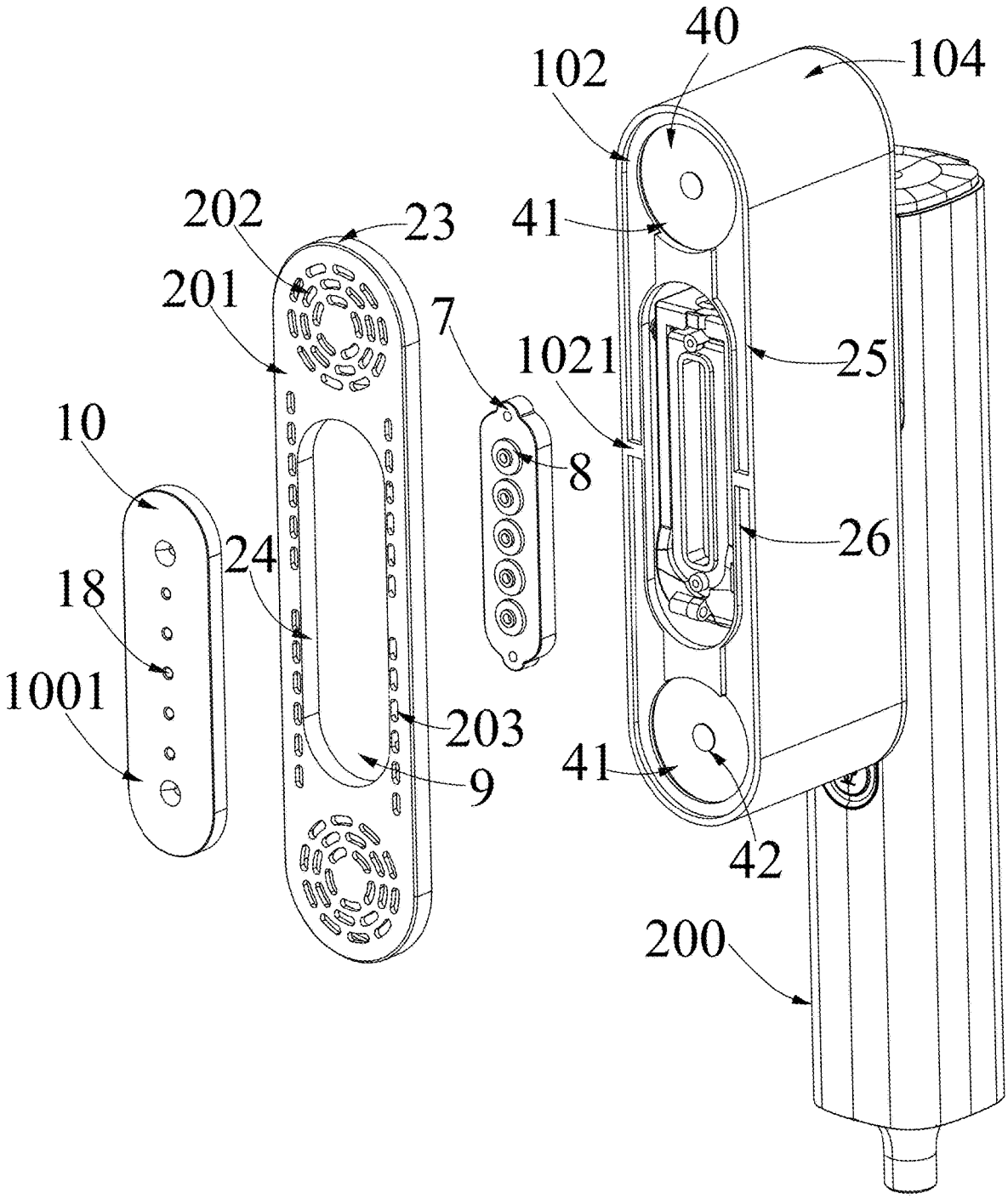
FIG. 15 is an exploded, perspective view in FIG. 11.
Figure 16:
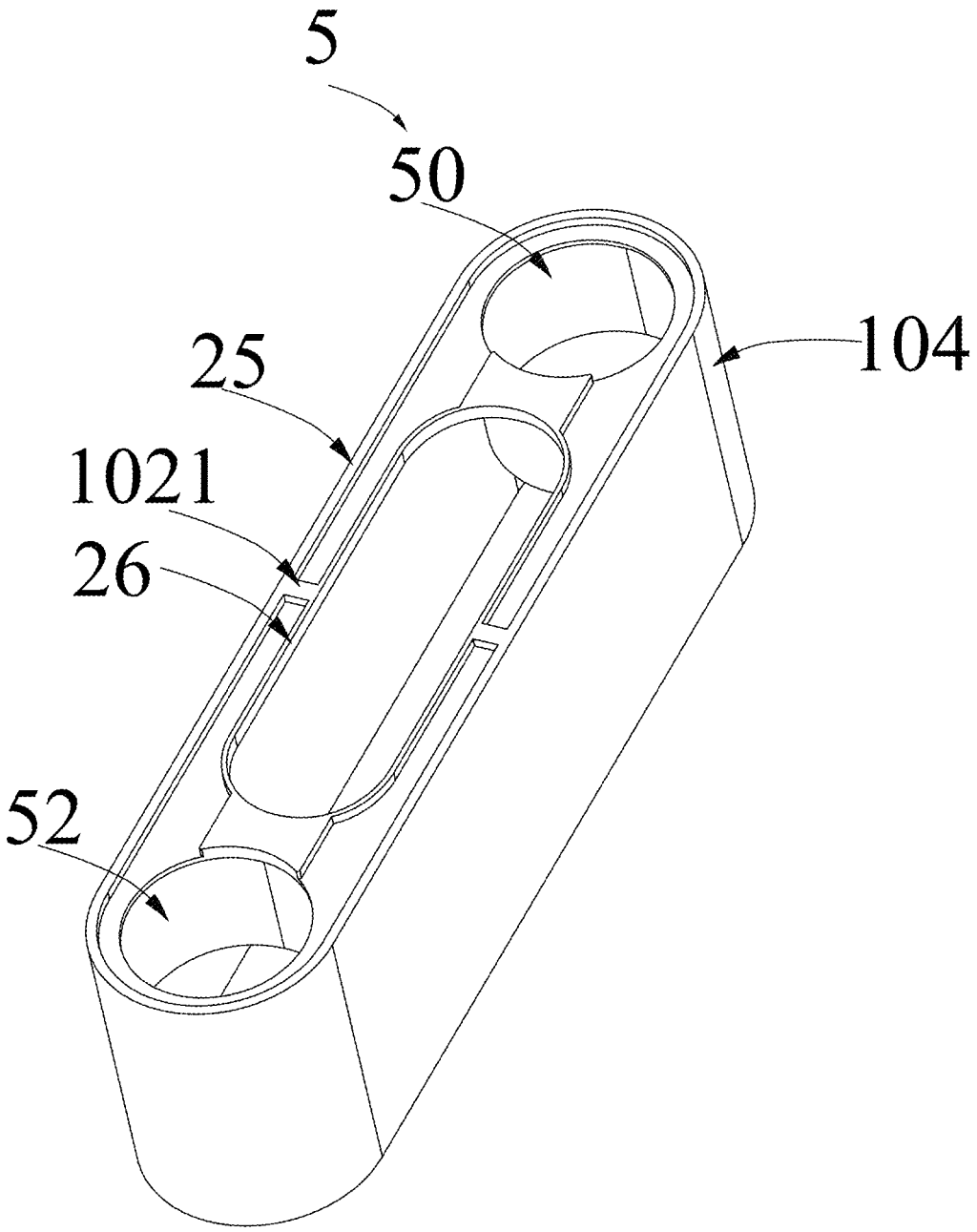
FIG. 16 is a perspective view of a main housing in FIG. 11 (the rear side plate is not shown).
Figure 17:
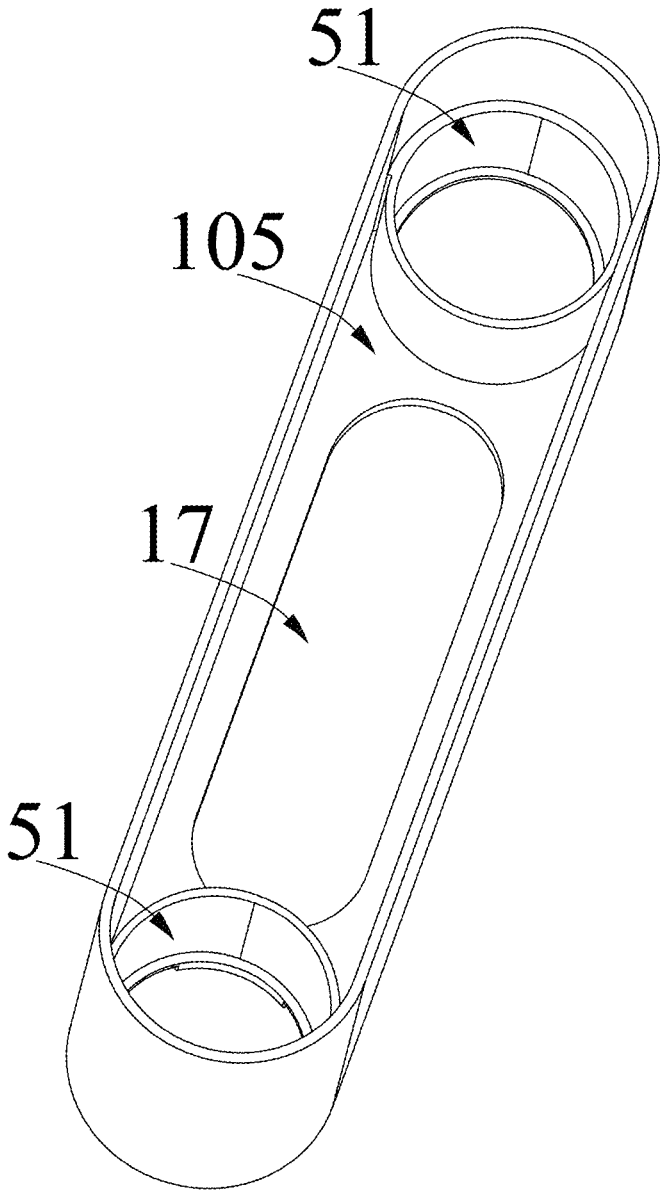
FIG. 17 is a perspective view of a main housing in FIG. 14 from another angle.
Figure 18:
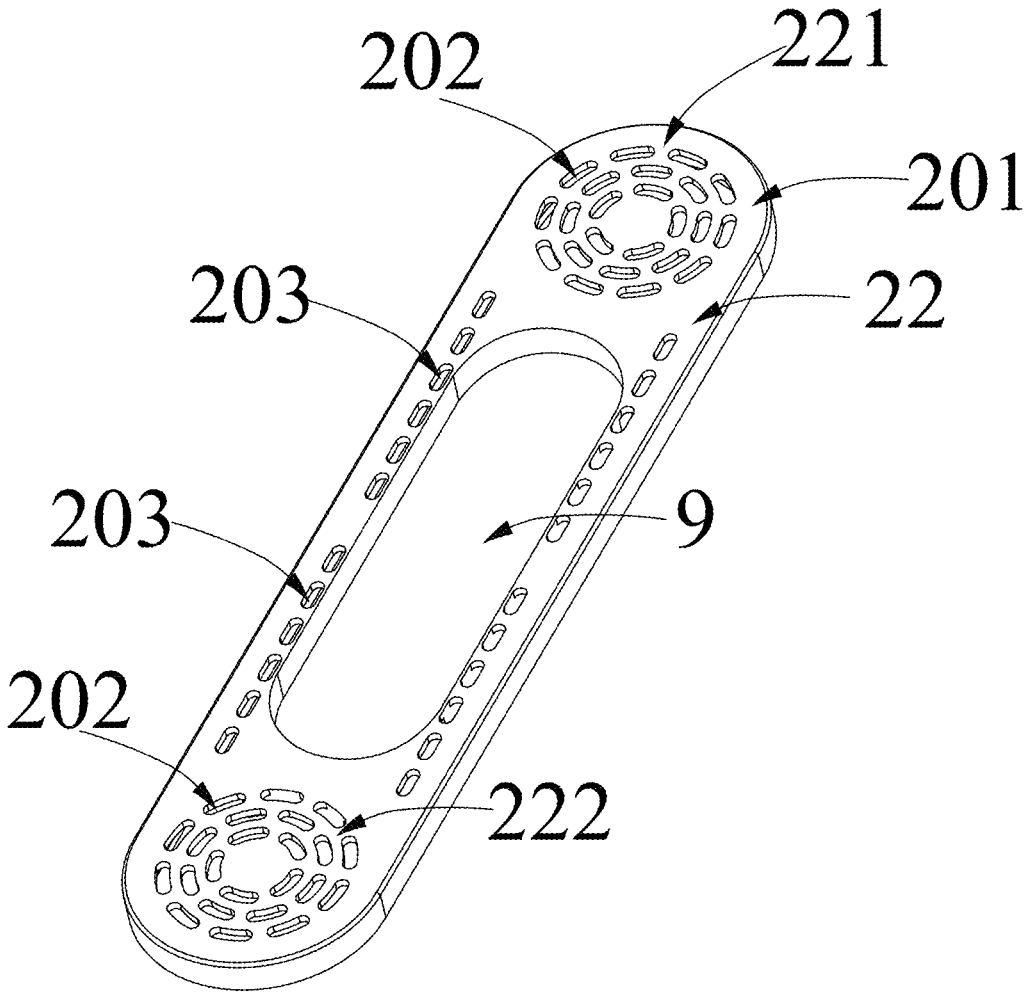
FIG. 18 is a perspective view of the suction housing in FIG. 11.
Figure 19:
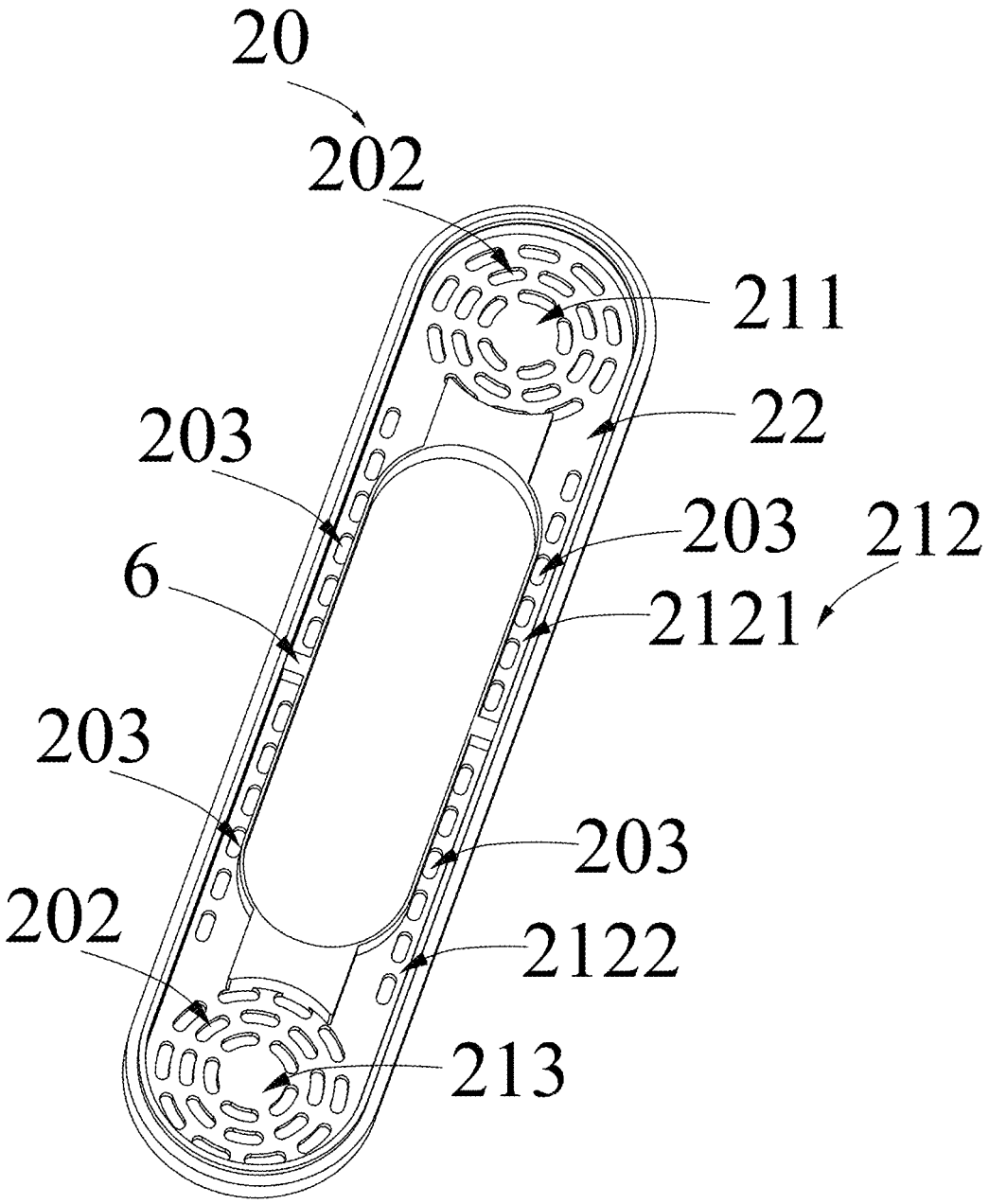
FIG. 19 is a perspective view of the suction housing in FIG. 18 from another angle.

Further, as shown in FIGS. 4, 8 and 9, the main housing 1 includes a rear side plate 103, a cylindrical sidewall 104, and a front side plate 105 arranged opposite to the rear side plate 103. The rear side plate 103, the cylindrical sidewall 104 and the front side plate 105 surround form a hollow interior 101. The front side plate 105 define the air inlet 5, and a tube wall 51 connected to the front side plate 105 is further provided in the hollow interior 101. The tube wall 51 is communicated with the air inlet 5, and the driving member 4 is installed in the tube wall 51.

The cylinder wall 51 may better secure the driving member 4 with the main housing 1, allowing the suction port of the driving member 4 to be conveniently in communication with the chamber 21 through the air inlet 5. This stabilizes the installation of the driving member 4, and facilitates the suction port 41 of the driving member 4 to be sealed and connected to the air inlet 5, thereby increasing the suction force of the driving member 4 and preventing the waste of suction force.

In the present embodiment, an annular mounting gasket is sleeved on the outer wall of the driving member 4. The annular mounting gasket may fill the gap between the driving member 4 and the cylinder wall, and improve the stability and tightness of the assembly between the driving member 4 and the cylinder wall 51.

The rear sidewall of the main housing 1 is defined with an air outlet 15 coaxially arranged with the driving member 4, and an inner wall of the rear side plate 103 is indented to form a receiving groove, and a boss 16 protruding outward is formed on an outer wall accordingly. The receiving groove installs the driving member 4 at the rear end to reduce the problems of poor connection effect of a cantilever end of the driving member 4.

In the present embodiment, the ironing head 100 further includes a heat-insulating seal 7. The heat-insulating seal 7 is arranged in the mounting port 17 and is located between the steam generator 3 and a heating panel 10. The heat-insulating seal 7 is defined with an air vent 8 communicating with the steam outlet 301 and the steam hole 18. In the present embodiment, the mounting port 17 facilitates the heat-insulating seal 7 to be installed between the main housing 1 and the suction housing 2.

In the present embodiment, the suction port of the driving member 4 and the steam outlet 301 of the steam generator 3 are located on a same plane, greatly reducing the suction distance between the suction port of the driving member 4 and the chamber 21, avoiding the problem of weak suction force of the driving member 4 due to the long suction distance, and effectively ensuring the suction capacity of the ironing head 100.

In the present embodiment, the driving member 4 and the steam generator 3 are both installed in the hollow interior 101 of the main housing 1. The driving member 4 is arranged in parallel with the steam generator 3, effectively utilizing the space in the hollow interior 101 and reduce the overall size of the ironing head 100.

Further, the ironing head 100 also includes a heating panel 10, which is arranged in the opening 9 and is fixedly connected to the steam generator 3. The heating panel 10 defines an ironing end surface 1001 and a steam hole 18. The ironing end surface 1001 and the end surface 201 are in a same plane, and the steam hole 18 is in communication with the steam outlet 301. A material of the heating panel 10 is configured as an aluminum alloy. In addition, the heating panel 10 may better cooperate with steam for flat ironing.

In the present embodiment, the heat-insulating seal 7 is made of silica gel, allowing the steam generated by the steam outlet 301 to enter the air vent 8 into the steam hole 18, and then to be discharged from the steam hole 18. Such a configuration may effectively prevent the steam heat at the steam outlet 301 from directly diffusing to the heating panel 10. In addition, the heat-insulating seal 7 may improve the sealing performance between the steam outlet 301 and the heating panel 10, thereby reducing steam leakage.

Figure 7:
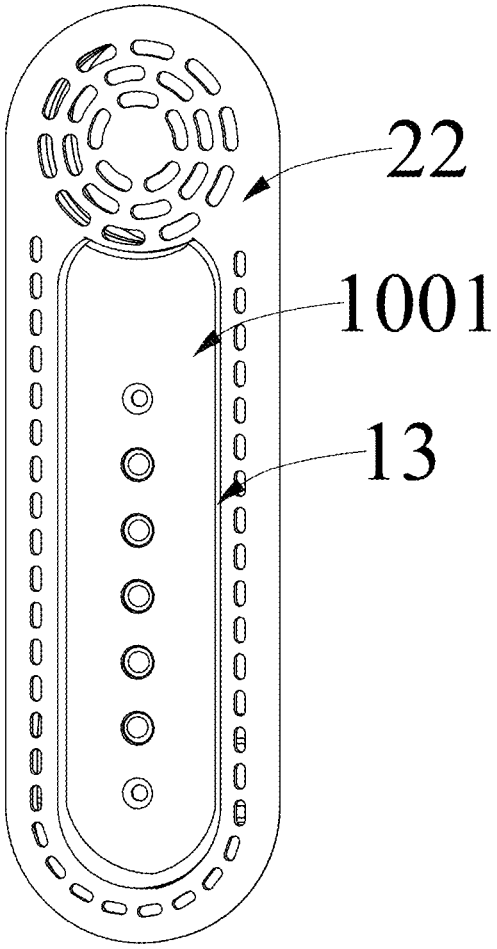
FIG. 7 is a front view of the suction housing of FIG. 1.

The heating panel 10 and a sidewall of the opening 9 surround to form an annular isolation cavity 13. The annular isolation cavity 13 prevents an air duct from taking away the heat of the heating panel. As shown in FIG. 7, it may better effectively isolate the heat brought by the steam from the suction wind.

Further, a side of the main housing 1 away from the suction housing 2 defines an air outlet 15, corresponding to the driving member 4. It is convenient for the steam to be discharged smoothly.

Further, a dustproof net 14 is provided at the air inlet 5. The dustproof net 14 may effectively prevent impurities from entering from the air inlet 5, and perform reasonable protection and dust prevention.

Example 2

As shown in FIG. 12 to FIG. 19, on the basis of Example 1, further, a plurality of primary inlet port groups 20 are formed, each primary inlet port group 20 includes a plurality of primary inlet ports 202. The plurality of primary inlet ports 202 included in each group of primary inlet port groups 20 are distributed in a circular array around an axis of the air inlet 5.

The air inlet 5 includes a first air inlet 50 and a second air inlet 52. The driving member 4 includes a first driving member 40 and a second driving member 42. The suction port 41 of the first driving member 40 and the suction port 41 of the second driving member 42 communicates with the first air inlet 50 and the second air inlet 52, respectively.

In addition, in the present embodiment, the ironing head 100 is rotatably connected to the handle 200. The main unit may control the ironing head 100 to rotate to different ironing directions. There is a gap between the rear side plate 103 of the ironing head 100 and the handle 200, and the gap is configured for air exhaustion of the air outlet 15.

Further, the suction housing 2 includes a first plate body 22 having a first end 221 and a second end 222. There are multiple primary inlet ports 202, some of which form a first main suction area at the first end 221, and the remaining primary inlet ports 202 form a second main suction area at the second end 222. There are multiple secondary inlet ports 203, and the multiple secondary inlet ports 203 are distributed along one edge of the first plate body 22 to form an auxiliary suction area. The one edge is between the first main suction area and the second main suction area. A first annular protrusion 23 is connected to a circumferential edge of the first plate body 22 and extends toward the first end surface 102. A second annular protrusion 24 is connected to a circumferential edge of the opening 9 and extends toward the first end surface 102.

The first annular protrusion 23 and the second annular protrusion 24 separate the chamber 21 into a first main chamber 211, a second main chamber 213 and an auxiliary chamber 212 which are in communication with each other. An inner wall of the first main chamber 211 defines the first main suction area. An inner wall of the second main chamber 213 defines the second main suction area. The plurality of primary inlet ports 202 is directly in communication with the first main chamber 211 and the second main chamber 213, the first main chamber 211 is in communication with the first air inlet 50, and the second main chamber 213 is in communication with the second air inlet 52. An inner wall of the auxiliary chamber 212 defines the sub-suction area, and the plurality of secondary inlet ports 203 are directly in communication with the auxiliary chamber 212.

There are two primary inlet port groups 20, and two driving members 4. The two driving members 4 are the first driving member 40 and the second driving member 42 arranged at upper and lower ends of the hollow interior 101, respectively. A first blocking block 6 is provided on the first plate body 22, and the first blocking block 6 is connected to both the first annular protrusion 23 and the second annular protrusion 24. A third annular protrusion 25 and a fourth annular protrusion 26 are provided on the first end surface 102. The third annular protrusion 25 is connected to an edge of the first end surface 102 and extends to one side of the first plate body 22. The fourth annular protrusion 26 is connected to an edge of the mounting port 17 and extends to one side of the first plate body 22. A second blocking block 1021 is also provided on the first end surface 102, and the second blocking block 1021 is connected to both the third annular protrusion 25 and the fourth annular protrusion 26.

After the suction housing 2 is assembled with the main housing 1, the first annular protrusion 23 is connected to the third annular protrusion 25. The second annular protrusion 24 is connected to the fourth annular protrusion 26. The first blocking block 6 is connected to the second blocking block 1021 to separate the auxiliary chamber 212 into a first auxiliary chamber 2121 and a second auxiliary chamber 2122. The first auxiliary chamber 2121 and the second auxiliary chamber 2122 are symmetrically arranged up and down. In order to enhance the suction force of the plurality of secondary inlet ports 203 which are away from the two driving members 4, driving members 4 are arranged at upper and lower ends of the hollow interior 101 correspondingly.

This arrangement shortens the distance between the plurality of secondary inlet ports 203 of the first auxiliary chamber 2121 in the auxiliary suction area and the first driving member 40, and shortens the distance between the plurality of secondary inlet ports 203 of the second auxiliary chamber 2122 and the second driving member 42. This ensures the suction force of the plurality of secondary inlet ports 203 in the auxiliary suction area. In addition, an additional second air inlet 52 is formed in the main suction area, further increasing the suction area and ensuring the ironing effect.

The first blocking block 6 and the second blocking block 1021 separates the auxiliary chamber 212 into the first auxiliary chamber 2121 and the second auxiliary chamber 2122 when the suction housing 2 is sealed and connected to the main housing 1. The ironing head 100 arranged in this way may effectively reduce airflow interference in the auxiliary chamber 212 when the first driving member 40 and the second driving member 42 are in operation. This allows the first auxiliary chamber 2121 and the second auxiliary chamber 2122 to be better adsorbed, thereby improving the suction effect of the auxiliary chamber 212.

In the present embodiment, apertures of the plurality of secondary inlet ports 203 in the plurality of secondary inlet ports area near the center of the heating panel 10 is large, which is more advantageous in improving the suction effect of the plurality of secondary inlet ports 203 of the plurality of secondary inlet ports area.

From the above description, it may be seen that the above-mentioned embodiments of the present disclosure achieve the following technical effects.

After assembling the main housing 1 and suction housing 2, the mounting port 17, opening 9, and steam outlet 301 communicate with each other to form a steam channel. This steam channel remains completely separated from the chamber 21. In this configuration, when the ironing head 100 operates, under the vacuum force of the suction drive component 4, negative pressure forms within the chamber 21, causing rapid airflow. Steam generated by the steam generator 3 discharges through the steam channel. The physical separation between the steam channel and chamber 21 prevents thermal energy from being carried away from the steam channel by airflow in the chamber. This preserves the thermal energy of the steam within the channel, ensuring effective ironing performance.

The suction port 41 of the suction drive component 4 directly interfaces with the air intake 5. This design significantly shortens the pathway between the suction drive component 4 and the chamber 21, preventing loss of suction capability in the ironing head 100 due to excessive conduit length. Consequently, the suction force of the ironing head is enhanced. Furthermore, the configuration of the primary intake ports 202 and secondary intake ports 203 ensures uniform suction force generation along the entire peripheral edges of the suction surface 201 during operation. This enables secure fixation of garments during ironing, significantly improving operational ease.

The above are only some embodiments of the present disclosure, and does not limit the patent scope of the present disclosure. All equivalent structural changes made by using the contents of the present disclosure specification and drawings under the inventive concept of the present disclosure, or directly/indirectly applied in other related technical fields are included in the protection scope of the present disclosure.

What is claimed is:

1. An ironing head, comprising:

a main housing defining a hollow interior, a first end surface of the main housing defining a first air inlet, a second air inlet, and a mounting port in communication with the hollow interior;

a steam generator defining a steam outlet, the steam generator being disposed in the hollow interior, and the steam outlet being in communication with the mounting port;

a suction housing connected to the first end surface of the main housing, the suction housing being connected to the first end surface to form a chamber, the chamber being in communication with the first air inlet and the second air inlet, an end surface of the suction housing defining a plurality of primary inlet ports and a plurality of secondary inlet ports in communication with the chamber, and the suction housing defining an opening; and a first driving member and a second driving member disposed in the hollow interior, and the first driving member and the second driving member each defining a suction port, and the suction port of the first driving member and the suction port of the second driving member being in communication with the first air inlet and the second air inlet respectively;

in response to the main housing and the suction housing are assembled, the mounting port, the opening and the steam outlet are in communication with each other form a steam channel, and the steam channel and the chamber are spatially independent;

wherein the suction housing comprises:

a first plate body having a first end and a second end, at least one of the plurality of primary inlet ports form a first main suction area at the first end, and a remaining of the plurality of primary inlet ports form a second main suction area at the second end, the plurality of secondary inlet ports are distributed along an edge of the first plate body between the first main suction area and the second main suction area to form an auxiliary suction area; and wherein the chamber is divided into a first main chamber, a second main chamber and an auxiliary chamber in communication with each other, the plurality of primary inlet ports is in communication with both the first main chamber and the second main chamber, the first main chamber is in communication with the first air inlet, the second main chamber is in communication with the second air inlet, and the plurality of secondary inlet ports is in communication with the auxiliary chamber.

2. The ironing head according to claim 1, wherein the main housing comprises:

a cylindrical sidewall having a front end and a rear end;

a front side plate connected to the front end of the cylindrical sidewall, the front side plate closing the front end of the cylindrical sidewall; and a rear side plate connected to the rear end of the cylindrical sidewall, the rear side plate closing the rear end of the cylindrical sidewall;

wherein the cylindrical sidewall, the front side plate and the rear side plate surround to form the hollow interior; the first air inlet, the second air inlet and the mounting port are both arranged on the front side plate, and a cylindrical wall connected to the front side plate is arranged in the hollow interior, and the cylindrical wall is in communication the first air inlet and the second air inlet.

3. The ironing head according to claim 2, further comprising a heating panel, wherein the heating panel is arranged in the opening and is fixedly connected to the steam generator, the heating panel defines an ironing end surface and a steam hole, the ironing end surface and the end surface of the suction housing are arranged on a same plane, and the steam hole is in communication with the steam outlet.

4. The ironing head according to claim 3, further comprising a heat insulation seal, the heat insulation seal is arranged in the mounting port and is located between the steam generator and the heating panel, and the heat insulation seal defines a vent hole in communication with the steam outlet and the steam hole.

5. The ironing head according to claim 1, wherein the suction housing further comprises:

a first annular protrusion connected to a circumferential edge of the first plate body and extending toward the first end surface; and a second annular protrusion connected to a circumferential edge of the opening and extending towards the first end surface;

wherein the first annular protrusion and the second annular protrusion divide the chamber into the first main chamber, the second main chamber and the auxiliary chamber in communication with each other, an inner wall of the first main chamber defines the first main suction area, an inner wall of the second main chamber defines the second main suction area; an inner wall of the auxiliary chamber defines the auxiliary suction area.

6. The ironing head according to claim 5, wherein the first main suction area defines a plurality of primary inlet port groups, each of the plurality of primary inlet ports groups includes at least one of the plurality of primary inlet ports, and the at least one of the plurality of primary inlet ports in each of the plurality of primary inlet ports groups are distributed in a circular array around an axis of the first air inlet.

7. The ironing head according to claim 6, further comprising a heating panel, wherein the heating panel is arranged in the opening and is fixedly connected to the steam generator, the heating panel defines an ironing end surface and a steam hole, the ironing end surface and the end surface of the suction housing are arranged on a same plane, and the steam hole is in communication with the steam outlet.

8. The ironing head according to claim 7, further comprising a heat insulation seal, the heat insulation seal is arranged in the mounting port and is located between the steam generator and the heating panel, and the heat insulation seal defines a vent hole in communication with the steam outlet and the steam hole.

9. The ironing head according to claim 5, wherein a first blocking block is provided on the first plate body, and the first blocking block is connected to both the first annular protrusion and the second annular protrusion; a third annular protrusion and a fourth annular protrusion are provided on the first end surface, the third annular protrusion is connected to an edge of the first end surface and extends towards the first plate body, the fourth annular protrusion is connected to an edge of the mounting port and extends towards the first plate body, and the third annular protrusion and the fourth annular protrusion are connected to the edge of the mounting port and extend towards the first plate body; a second blocking block is provided on the end surface, and the second blocking block is connected to both the third annular protrusion and the fourth annular protrusion;

in response to the suction housing and the main housing are assembled, the first annular protrusion is connected to the third annular protrusion, and the second annular protrusion is connected to the fourth annular protrusion;

the first blocking block is in communication with the second blocking block to divide the auxiliary chamber into a first auxiliary chamber and a second auxiliary chamber.

10. The ironing head according to claim 5, further comprising a heating panel, wherein the heating panel is arranged in the opening and is fixedly connected to the steam generator, the heating panel defines an ironing end surface and a steam hole, the ironing end surface and the end surface of the suction housing are arranged on a same plane, and the steam hole is in communication with the steam outlet.

11. The ironing head according to claim 1, further comprising a heating panel, wherein the heating panel is arranged in the opening and is fixedly connected to the steam generator, the heating panel defines an ironing end surface and a steam hole, the ironing end surface and the end surface of the suction housing are arranged on a same plane, and the steam hole is in communication with the steam outlet.

12. The ironing head according to claim 11, further comprising a heat insulation seal, the heat insulation seal is arranged in the mounting port and is located between the steam generator and the heating panel, and the heat insulation seal defines a vent hole in communication with the steam outlet and the steam hole.

* * * * *